US006460478B1

(12) United States Patent
Widmer

(10) Patent No.: US 6,460,478 B1
(45) Date of Patent: Oct. 8, 2002

(54) ROTATIONAL MOLDED ARTICLE AND METHOD

(76) Inventor: Stanley Wayne Widmer, RR 1 box 322 Stanley Widmer Associates Inc. 1206 Prairie Ave W., Staples, MN (US) 56479

( * ) Notice: Subject to any disclaimer, the term of this patent is extended or adjusted under 35 U.S.C. 154(b) by 42 days.

(21) Appl. No.: 09/746,173

(22) Filed: Dec. 21, 2000

Related U.S. Application Data

(60) Provisional application No. 60/173,115, filed on Dec. 27, 1999.

(51) Int. Cl.[7] ..... B63B 5/24
(52) U.S. Cl. ..... 114/357
(58) Field of Search ..... 114/357

(56) References Cited

U.S. PATENT DOCUMENTS 5,253,607 A * 10/1993 Chen ..... 114/357
5,601,048 A * 2/1997 MacDougall ..... 114/357
6,325,014 B1 * 12/2001 Blanchard ..... 114/352

* cited by examiner

*Primary Examiner*—Jesus D. Sotelo
(74) *Attorney, Agent, or Firm*—Robert W. Gutenkauf, Esq.; Malcolm D. Reid, Esq.; Peter Forrest, Esq.

(57) ABSTRACT

A rotational molded boat or equivalent floatable marine structure has parallel hull walls interconnected by rows of spaced apart, molded V-shaped connectors. The connectors are formed in the rotational molding process. One of the mold sections has a mold surface for forming one of the hull walls, said surface having one or more rows of V-shaped indentations projecting toward an opposite mold surface. The V-shaped indentations have apexes that are spaced apart from the opposite mold surface by a distance that, during the molding process, will fill with molten material to form a molded connection between the finished hull walls. In another embodiment, a lattice structure is assembled to the mold and molded in between side wall components of the hull.

21 Claims, 6 Drawing Sheets

ROTATIONAL MOLDED ARTICLE AND METHOD

CROSS REFERENCE TO RELATED APPLICATION

Reference is made to United States Provisional Patent Application No. 60/173,115 filed Dec. 27, 1999.

BACKGROUND OF THE INVENTION

The invention pertains to a hollow walled article manufactured by a rotational molding process, and the process thereof. More particularly, the invention pertains to a rotational molded boat and the process of molding the boat.

Rotational molding is intended primarily for the manufacture of hollow structures from thermoplastic and, to some extent, thermosetting materials.

A solid or liquid polymer is placed in a mold; the mold is heated and then cooled while being rotated about two perpendicular axes simultaneously. During the first portion of the heating stage when molding with powdered material, a porous skin is formed on the mold surface. This gradually melts as the cycle progresses to form a homogeneous layer of uniform thickness adhering to the mold's surface. When molding a liquid material, it tends to flow and coat the mold's surface until the gel temperature of the resin is reached, at which time all flow ceases. The shape of the object being molded conforms to the inside surfaces of the mold. The structure is hollow between the molded surfaces.

When all flow ceases, the mold is indexed to a cooling station, where the mold is cooled. It is then positioned in a work zone, where the mold is opened, the finished part removed, and the mold recharged for the next cycle.

Rotational molding of objects, such as boat hulls, is not new. In the case of boats, the process produces a hollow boat hull with an inner and outer walls. The hollow space in between is conveniently filled with foam for purposes of buoyancy and strength. The inner and outer walls are desireably connected for purposes of rigidity of the structure. This is usually accomplished along one or more ribs that run lengthwise of the hull. The rib is formed by closing the mold during the rotational molding process in order to bring together and fuse projecting opposing surfaces. This process is described in U.S. Pat. No. 3,663,680 issued May 16, 1972 to Ringdal.

SUMMARY OF THE INVENTION

A hollow-walled structure having spaced apart walls, such as a boat hull or other marine hull, is formed by a rotational molding process. For purposes of structural integrity certain walls of the structure are inter-connected according to the invention. Opposing walls are connected by one or more rows of spaced apart molded connectors or joints.

The molded connectors are formed during the molding process. The mold has two or more sections that are assembled or closed for the manufacturing process. Selected mold surfaces. involved in the formation of the hollow-walled structure are provided with V-shaped indentations that project into the space between one mold surface and an opposing mold surface. The projecting members form a constriction between the two mold surfaces so that molten material fills the space to form a molten joint. The indentations are short and are spaced apart along a row. During molding, molten material flows between the indentations so as not to obstruct the process of molding the entire structure. One or more rows of such molded connecting joints are formed, greatly enhancing the structural integrity of the molded object.

A boat molded by such a process has hollow side walls and a hollow bottom wall formed of an inner bottom wall component and an outer bottom wall component. The bottom wall components are connected by the spaced apart molded joints. The boat can be a bass fishing boat, a duck boat, a pontoon boat, sail boat or a normal utility boat. The inner wall of the boat can be molded according to the requirements of the boat. For example, a bass fishing boat can have a number of compartments, a motor well and a bulkhead for mounting a steering assembly and various instrumentation. Other objects that can be molded include pontoons for a pontoon boat, dock sections and other such hollow walled structures.

In terms of a boat hull, the invention also includes the process of forming trusses in the sidewalls of the boat hull, and a boat hull finished having such interior trusses. The trusses are formed by including a lattice in the sections of the mold that will form the boat side walls. The lattice is connected to the inner mold before the mold is closed. Portions of the latticework are in close proximity to the mold surfaces. When the rotational molding process begins, the thermoplastic material bonds to the lattice, and bonds the lattice to the boat hull walls. The resultant trusses add strength and stability to the side walls of the boat hull. The boat hull can be a conventional boat hull or thermoplastically molded hulls for pontoons in the formation of a pontoon boat.

IN THE DRAWINGS

FIG. 3 also shows a portion of the mold used in the manufacture of the boat of FIG. 2, for purposes of showing the manufacturing process;

DESCRIPTION OF PREFERRED EMBODIMENTS

Figure 1:
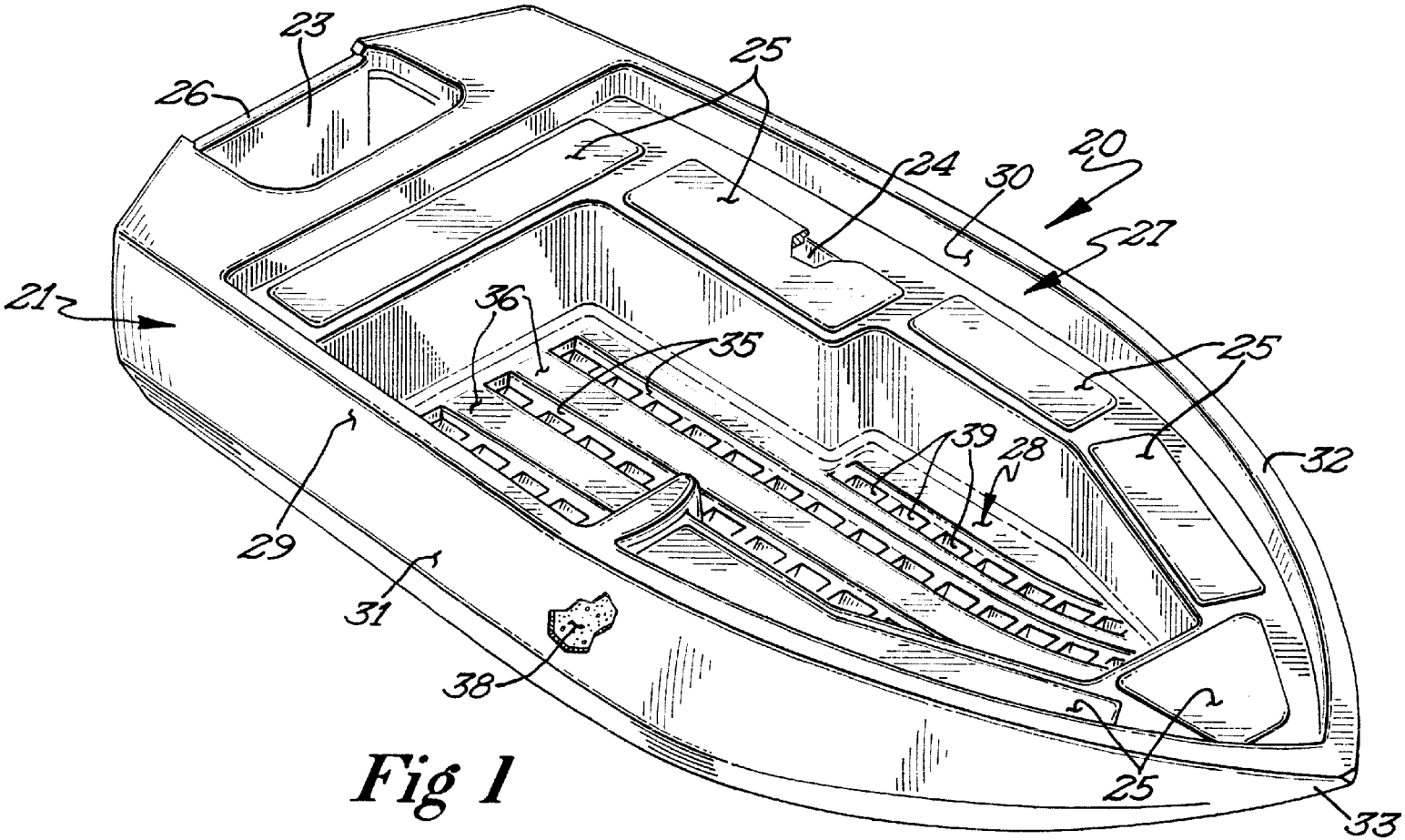
FIG. 1 is a perspective view of a utility boat according to the invention manufactured by the rotational molding process of the invention.
Figures 2, 3:
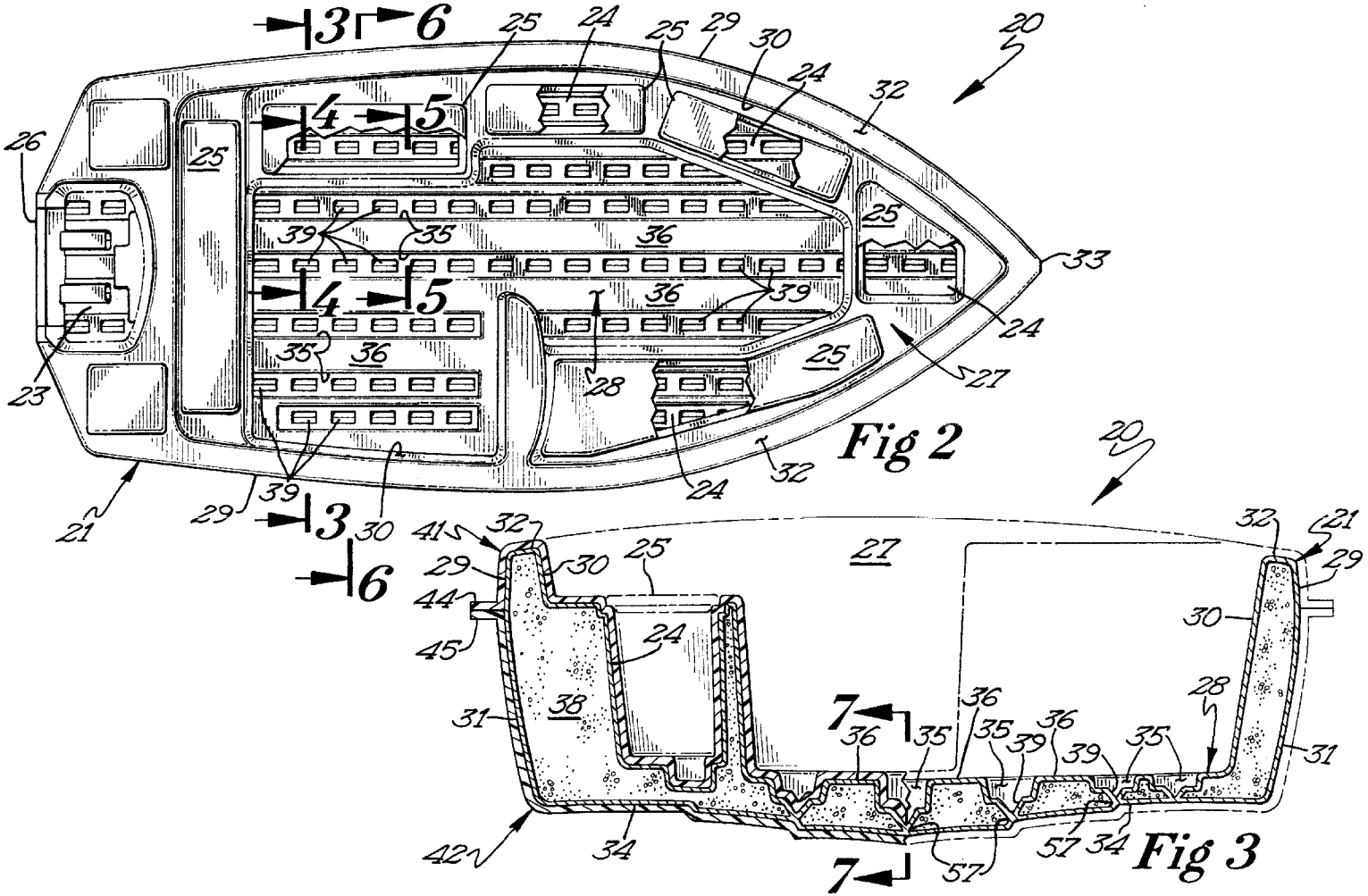
FIG. 2 is a top plan view of the boat of FIG. 1.
FIG. 3 is an enlarged sectional view of the boat of FIG. 2 taken along the line 3—3 thereof.
Figure 6:
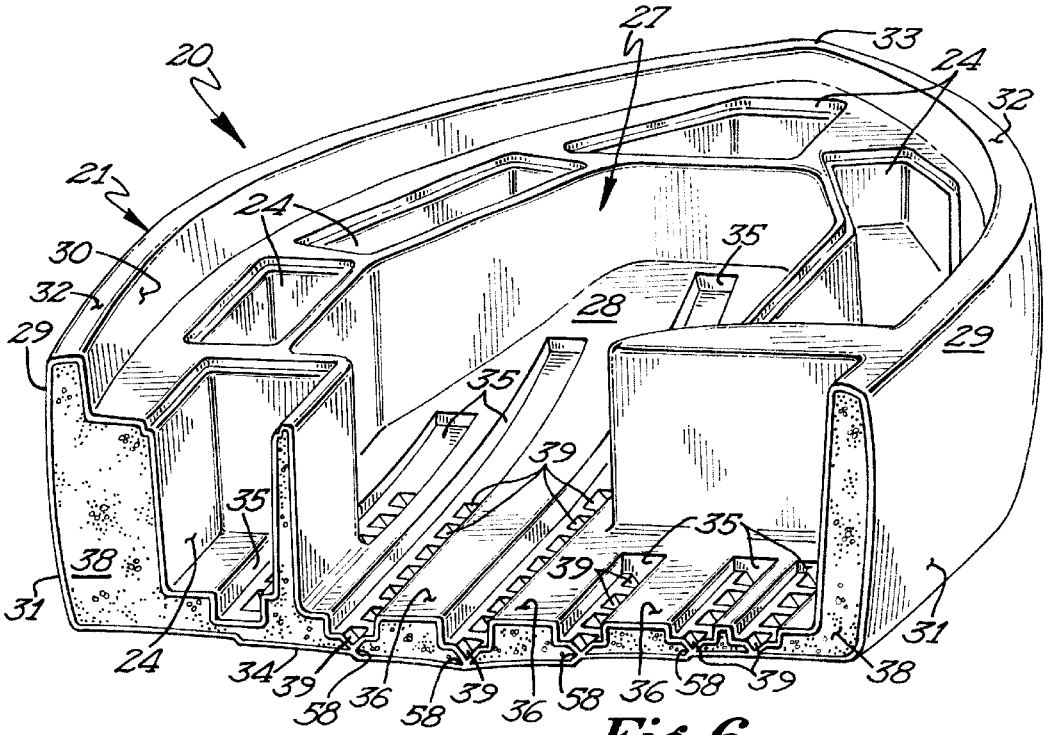
FIG. 6 is a cutaway perspective view of the boat of FIG. 1 to illustrate interior structures of the hull.

Referring to the drawings, there is shown in FIGS. 1, 2 and 6 a hollow-walled, rotationally molded structure according to the invention. More particularly, a boat 20 is formed with a one-piece molded plastic hull 21. Hull 21 has a motor well 23 and a plurality of compartments 24. Compartments have covers 25. The boat has an interior space 27 for occupants. The boat can be the configuration of an conventional boat, such as a runabout, bass fishing boat, sailboat or the like. Boat 20 has side walls 29, a bow 33 and a transom 26. Boat 20 has a bottom wall that can be covered by a floor (not shown).

As shown in FIG. 3, the hull 21 has an inner hull wall 30 and an outer hull wall 31 spaced from the inner wall. The inner and outer hull walls are connected by a gunwale 32. An inner bottom wall component 28 is part of the inner hull wall 30. The hull 21 has an outer bottom wall component 34 that is part of the outer hull wall 31. The space between the hull walls can be filled with foam for purposes of buoyancy and safety.

As shown in FIGS. 2 and 3, the inner bottom wall component 28 has a plurality of longitudinal channels 35. The longitudinal channels 35 are separated by a plurality of longitudinal ribs 36. The ribs and channels stabilized the bottom of hull 21. A plurality of molded connectors or joints connect the inner bottom wall component 28 to the outer bottom wall component 34.

FIG. 6 shows in cutaway view, the outer hull wall 31 of hull 21, the inner hull wall 30, the inner bottom wall component 28 and the outer bottom wall component 34. A foam 38 fills the space between the inner and outer hull walls. FIG. 6 shows the channels 35 separated by the ribs 36. Molded joints 39 are formed in the channels 35. The joints 39 are spaced apart in the channels 35 longitudinally along the length of the boat as shown in FIGS. 2 and 6. Each joint 39 has a V-shaped configuration with an apex bonded to the outer bottom wall component 34. The numerous joints 39 securely join the inner bottom wall component 28 of hull 21 to the outer bottom wall component 34.

Figure 4:
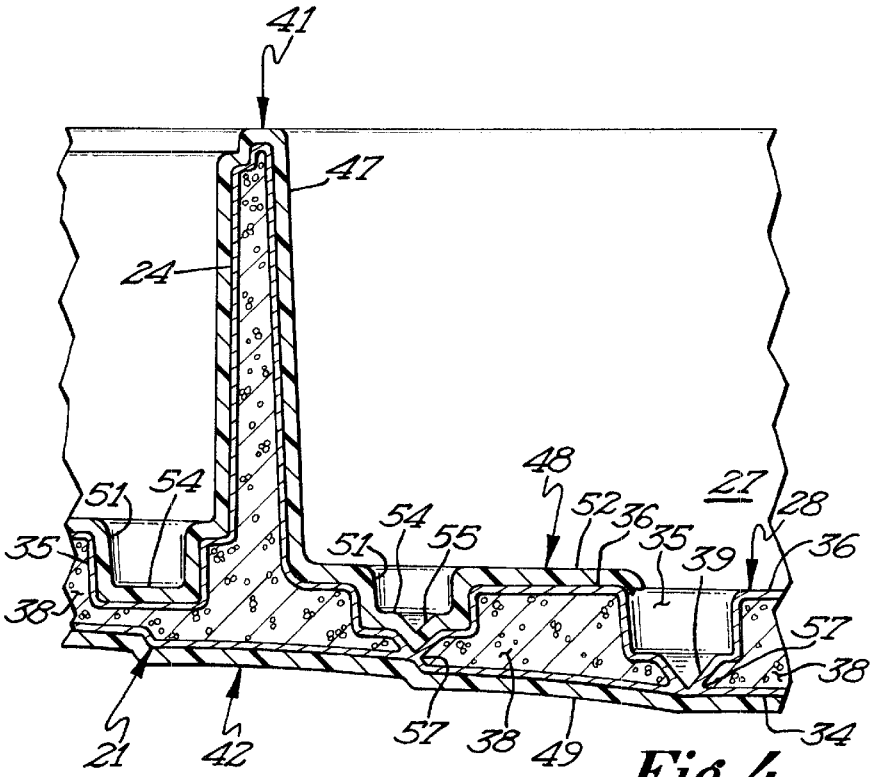
FIG. 4 is an enlarged sectional view of a portion of the boat of FIG. 2 taken along the line 4—4 thereof and is essentially an enlargement of a portion of the boat and mold shown in FIG. 3.
Figure 5:
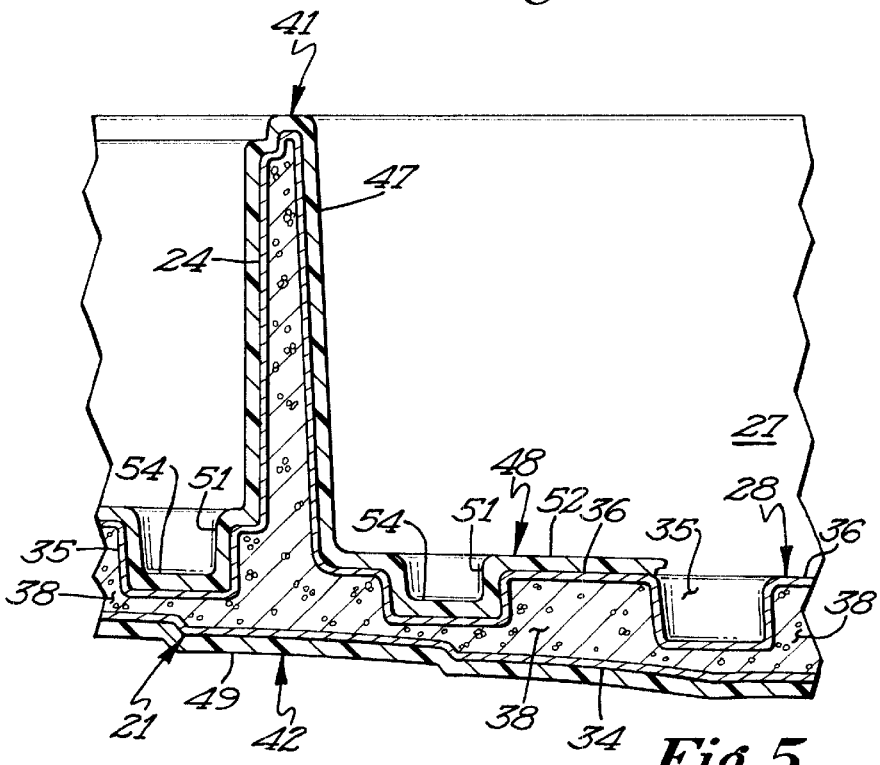
FIG. 5 is enlarged sectional view like that of FIG. 4 taken along the line 5—5 of FIG. 2 and also showing a portion of the mold in place to illustrate the manufacturing process.

The sectional view of FIG. 3 shows the ribs 36 of the boat 20, the channels 35 and the molded joints 39 formed in the channels 35. The left side of FIG. 3 shows the mold in position during the manufacturing process of the boat. FIGS. 4 and 5 are taken as sections along FIG. 2 but also shows parts of the mold for purposes of illustrating the invention.

FIG. 3 shows two mold sections, a first or upper mold section 41 and a second or lower mold section 42. The upper mold section has a peripheral lip 44 that joins to a corresponding peripheral lip 45 on the lower mold section 42 when the mold is closed.

The upper mold section 41 has a shape that conforms to the intended exterior shape of the upper portion of the boat. This includes indentations for the various compartments, and rises (such as the riser 47 in FIG. 4) for the various walls, and the like. In like fashion, the lower mold section 42 is shaped to conform to the intended shape of the lower portion of the boat including side walls and the bottom hull wall.

The upper mold section 41 has a surface for forming the inner bottom wall component of hull 21. As shown in FIGS. 4 and 5, the upper mold section 41 includes an inner bottom wall forming surface 48. The bottom forming surface 48 has a plurality of parallel channels 51. The channels 51 are separated by flats 52 which eventually form the ribs 36 of the boat bottom. The lower mold section 42 has a corresponding surface 49 for forming the outer bottom wall component 34.

A plurality of spaced apart indentations 54 are formed in the channels 51. Each indentation 54 has an apex 55. The apex 55 projects into the space between the bottom forming surface 48 of the upper mold 41 and the bottom forming surface 49 of the lower mold 42. The apex 55 produces a constricted area between the two bottom forming surfaces. The constricted region is indicated at 57 in FIG. 4. The gap or clearance between the molding surfaces at the constriction 57 is purposefully so narrow that the region will completely fill with molten material during the molding process. This forms a molded joint between the two hull walls. The indentations 55 with the apexes 57 form the molded joints 39 along the channels 35 of the boat hull.

Figure 7:
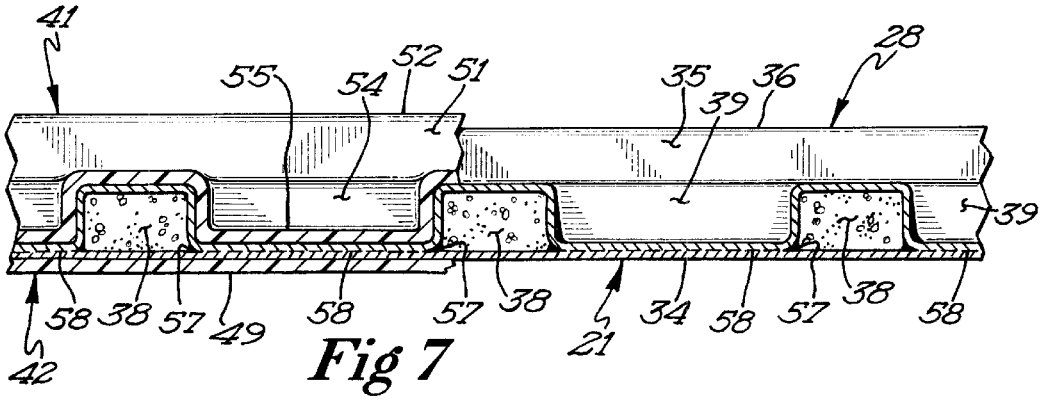
FIG. 7 is an enlarged sectional view of a portion of the boat of FIG. 3 taken along the line 7—7 thereof.

The indentations 55 are spaced apart longitudinally along the channel 51 of the bottom forming surface 48 of the upper mold 41. This results in the spaced apart joints 39 in the channels 35 shown in FIG. 2. The indentations are spaced apart to permit molten material to flow between them during the molding process. FIG. 5 is a section taken along the line 5—5 of FIG. 2 ahead of one of the molded joints. It shows clearance between the channel 51 and the bottom wall 49. The clearance is sufficient to permit flow of molten material without constriction. The spaced relationship between indentations 54 is also shown in FIG. 7. The region of bonding between the upper and lower hull walls is indicated at 58 in FIG. 7.

The molding process according to the method of making a hollow walled structure can be seen in FIGS. 3 through 7. A mold is provided having first and second mold sections of a rotational molding type. The sections are closed, forming a shape bounded by confronting interior mold walls according to the intended shape of the object being manufactured. One mold section has a surface for forming a first wall. The other mold section has a surface for forming a second wall. One surface has one or more rows of V-shaped indentations. The indentations have apexes that project toward the other molded surface. The apex forms a constriction between the mold surfaces. The constriction is of such a size that it will be filled with molten material during the molding process. This will harden to form a connection between the confronting walls of the structure being manufactured. The aligned indentations are spaced apart along a channel thus providing intervals in the channel between the joints to permit flow of molten material between them to the remainder of the mold.

FIG. 3 shows the upper and lower mold sections closed. Thermoplastic material is introduced into the cavity of the closed mold. The mold is heated and rotated in the usual rotational molding process. Flowing material adheres to and coats the interior mold surfaces, forming walls of the object being manufactured. The thermoplastic material fills the region of constriction 57 between the apex 55 of an indentation 54 on one mold wall and the opposite mold wall. Thermoplastic material flows around the ends of the indentation to travel to other mold portions. The constrictions do not inhibit the molding process.

After the plastic has been introduced into the mold and heated, then cooled, a foam material 38 can be introduced into the spaces between the molded walls.

Upon completion, the mold is opened and the molded structure is removed. In the case of the boat illustrated, a large number of molded joints 39 are located in the various parallel channels 35. The bonding of the inner and outer hull walls stabilizes and strengthens the hull. The resultant boat hull is strong, resists buckling, and is economical to manufacture.

It can be seen that the molding process can be employed to produce other rotational molded, hollow-walled articles such as sections of a boat dock, or pontoons for a pontoon boat.

Figure 8:
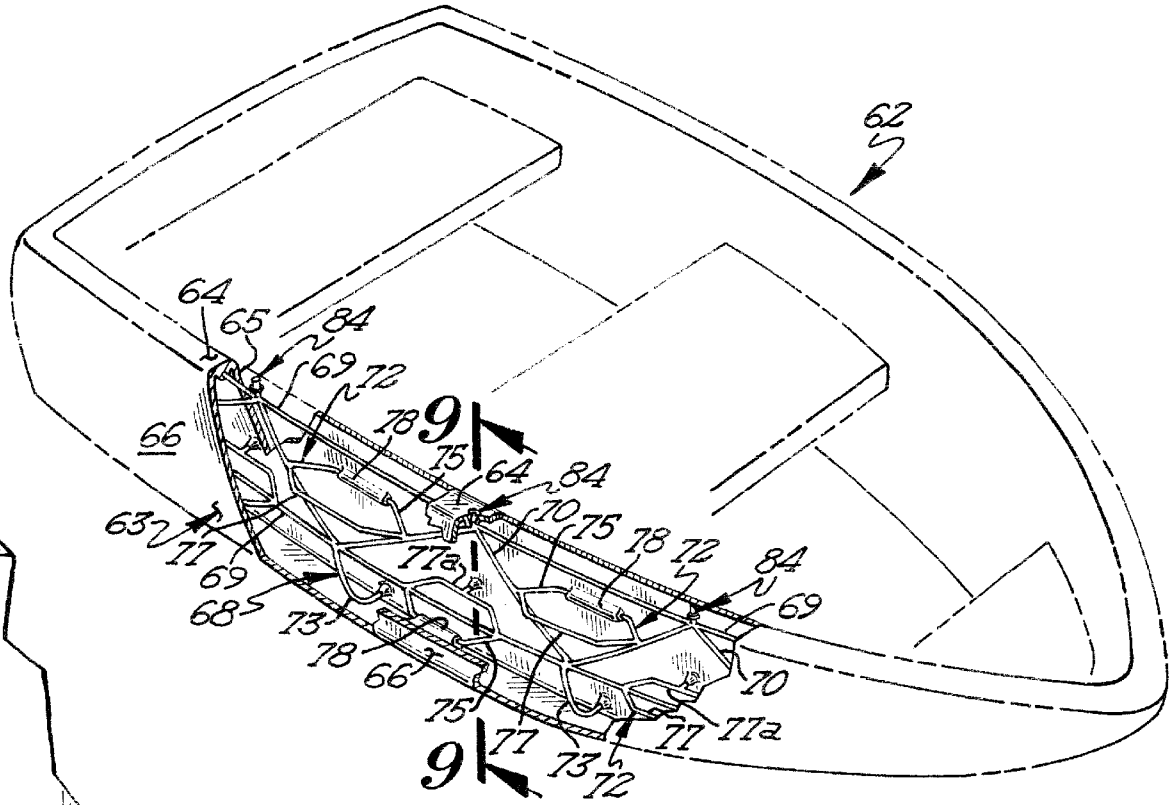
FIG. 8 illustrates a utility boat of the present invention manufactured according to another embodiment of the invention with a portion of the side wall cut away.

Another embodiment of the invention is shown in FIGS. 8 through 12. FIG. 8 shows a utility boat 62 manufactured by a rotational molding process. Boat 62 has a hollow side wall 63 shown with a portion of the outer wall cut away for purposes of illustration. Side wall 63 is hollow, comprised of an inner wall component 65 and an outer wall component 66. A lattice truss 68 is installed in the hollow of side wall 63. Truss 68 extends substantially the length and height of side wall 63 and serves to reinforce the side wall. Truss 68 is attached by molded connections to the interior surface of the inner and outer wall components 65, 66 of side wall 63.

Lattice 68 is formed of a framework consisting of a plurality of inter-connected wire rods or tubular members. This includes longitudinal stringers, diagonal members, braces and the like.

Figure 11:
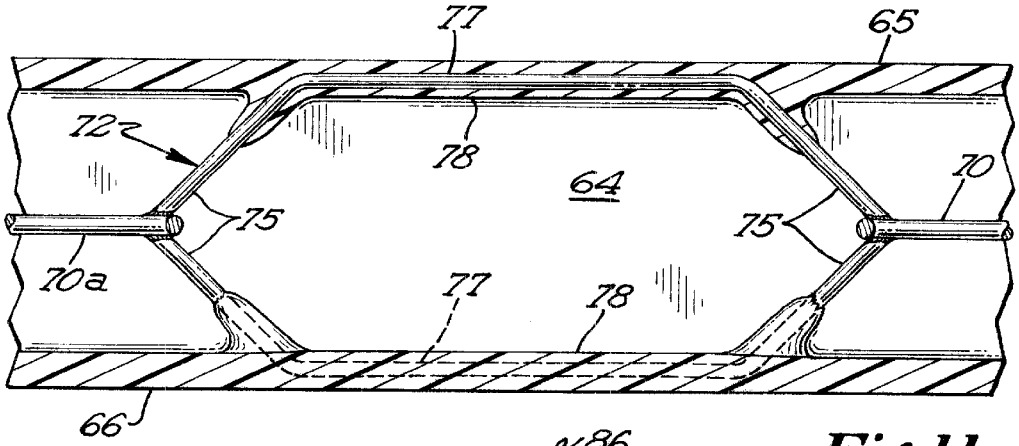
FIG. 11 is another enlarged sectional view of a portion of the boat side wall of FIG. 9 taken along the line 11—11 thereof.

FIG. 8 shows a longitudinal stringer 69 connected to diagonal members 70 and horizontal brace sections 72. The longitudinal and diagonal members are generally centrally located within the hollow of the side wall 63. Brace members 72 are polygonal and are positioned between the side wall component 65 and 66 of the side wall 63. Referring to FIG. 11, a brace 72 is connected between diagonal lattice members 70, 70A. The brace 72 includes arms 75 that extend outwardly from the diagonal members 70, 70A. The arms 75 are joined to legs 77. Legs 77 are parallel to and positioned close to the wall components 65, 66. The legs 77 of the brace 72 are integrally molded into the interior surfaces of the side wall 63. These molded connections are indicated at 78.

Figure 9:
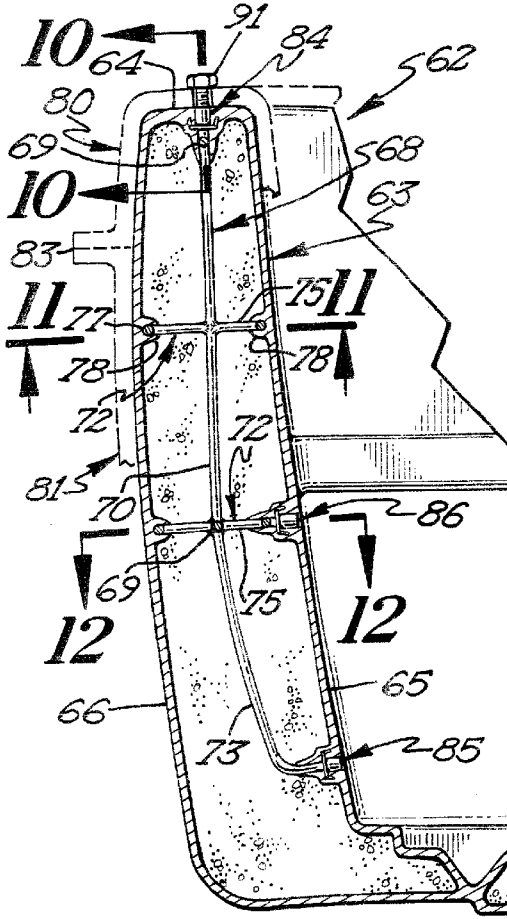
FIG. 9 is an enlarged sectional view of a portion of the side wall of the boat of FIG. 8 taken along the line 9—9 thereof.

The lattice includes a plurality of vertical stabilizers 73 (FIG. 9). The stabilizers 73 are connected to the various lattice members and to the inner side wall component 65 of the hull side wall 63.

Figure 10:
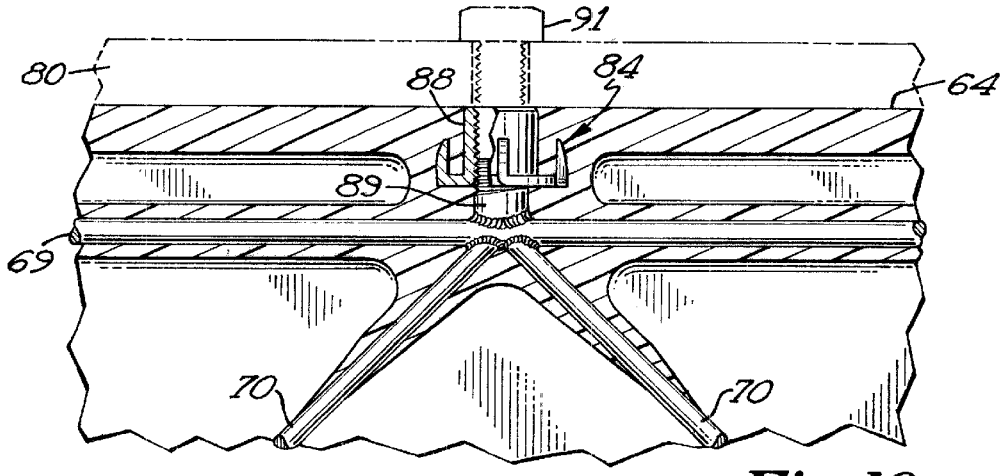
FIG. 10 is an enlarged sectional view of a portion of the boat side wall of FIG. 9 taken along the line 10—10 thereof.
Figure 12:
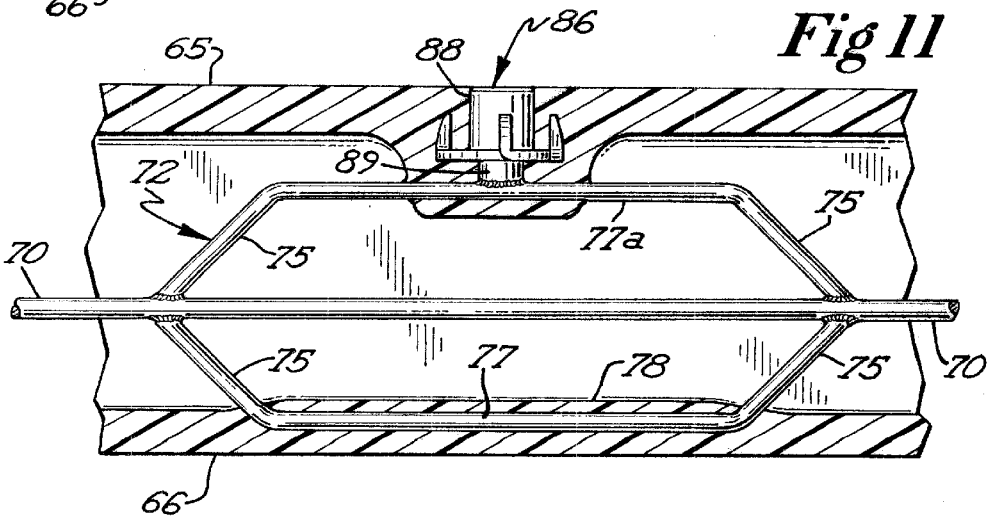
FIG. 12 is a yet further enlarged sectional view of a portion of the boat side wall of FIG. 9 taken along the line 12—12.

The lattice truss 68 is installed in the side wall 63 of boat 62 as part of the rotational molding manufacturing process. In FIG. 9 an upper mold section is indicated at 80, and a lower mold section at 81. The mold sections have peripheral lips 83 that are connected when the mold is closed. The lattice 68 has a plurality of teenut-type connectors. A teenut-type connector 84 is located at the upper extremity of the lattice 68 (FIGS. 9 and 10). Another teenut connector 85 is located at the end of a stabilizer 73. Another teenut connecter 86 is located on a leg 77A of a brace section 72 (FIGS. 9 and 12).

Each teenut connector is embedded in a component of the hull wall formed at the inner mold 80. The upper teenut connector 84 is embedded in the gunwale 64. The intermediate and lower T-connectors 86, 85 are embedded in the inner wall component 65 of the side wall 63. As shown in FIG. 10, a teenut connector includes a threaded collar 88 connected by a shank 89 to one of the members of the lattice 68.

The inner mold section 80 has openings that correspond with the locations of the teenut connectors on the lattice 68. This is so that the lattice 68 can be securely fastened to the upper mold section 80. FIG. 9 shows a bolt 91 extending through the upper mold section 80 and engaging the threaded collar of upper teenut connector 84 in the region where the gunwale 64 will be formed.

In the process of manufacture of boat 62, the lattice 68 is assembled to one of the mold sections. In the example shown, the lattice 68 is assembled to the inner mold section 80. It is assembled to the mold section with bolts passing through suitable openings in the mold wall and engaging the teenut connectors, for example the bolt 91 engaging the teenut connector 84. Then the mold is closed. Legs 77 of the braces 72 are positioned close to, but spaced slightly from, the inside surfaces of the mold sections that will form the side wall components 65, 66.

The rotational molding process then commences. The plastic material is introduced into the mold cavity. The mold is heated which melts the plastic forming a molten material that coats the inner surfaces of the mold including the surfaces of the legs 77 of the braces 72. The molten material also coats the regions surrounding the teenut connectors 84, 85, 86 and the joints connecting the. various members of the lattice 68. In this process, the lattice 68 is firmly embedded in the completed boat wall 63. The molded joints 78 are formed over the legs 77 that the are adjacent the interior surfaces of the mold walls.

Upon completion, the teenut connectors remain embedded in the boat hull. They can be used to fasten hardware to the boat.

The embodiments of the invention in which an exclusive property or privilege is claimed are defined as follows:

1. A hollow walled boat formed by a rotational molding process, including:

a hull having hollow side walls and a hollow bottom wall;

said bottom wall formed of a molded inner bottom wall component and a molded outer bottom wall component;

said inner bottom wall component having a plurality of generally parallel longitudinal channels;

each channel having an array of spaced apart connecting joints connecting the inner bottom wall component to the outer bottom wall component;

each connecting joint comprised as a downwardly directed V-shaped indentation with an apex that is bonded to the outer bottom wall component during the rotational molding process.

2. The boat of claim 1 including:

a lattice truss rotationally molded into the side walls of the hull.

3. The boat of claim 2 wherein:

the boat side walls include an inner side wall component and an outer side wall component;

said lattice truss including polygonal braces having legs molded into the side wall components.

4. The boat of claim 3 wherein:

said lattice truss includes teenut connectors molded into the boat hull.

5. The boat of claim 3 wherein:

said side wall components are connected by a gunwale, and including teenut connectors molded into the gunwale.

6. The boat of claim 2 wherein:

said lattice truss includes longitudinal stringers, diagonal members connected to the stringers, polygonal braces connected to diagonal members, said braces having legs molded into side wall components of the side walls.

7. The boat of claim 6 including:

a plurality of teenut connectors connected to the lattice truss and molded into the boat hull.

8. A method of rotational molding a boat hull with first and second opposing hull walls interconnected by a plurality of rows of molded V-shaped joints, comprising the steps of:

providing a first mold section shaped according to the upper part of a boat hull and having a first mold surface for forming said first hull wall, said first mold surface having a plurality of channels and a plurality of rows of spaced apart V-shaped indentations located in the channels;

providing a second mold section that assembles with the first mold section to form a closed mold, said second mold section shaped according to the lower part of a boat hull and having a second mold surface for forming said second hull wall, said second mold section relatively positionable with respect to the first mold section when the mold is closed so that the V-shaped indentations on the first mold surface project toward the second mold surface with apexes spaced from the second mold surface a distance forming a constriction of a size that will fill with molten material during a rotational molding process to form a molded connection between the first and second hull walls of the boat;

closing the first and second mold sections, introducing a thermoplastic material into the closed mold cavity formed by the closed mold sections, heating the mold and rotating the mold about at least two axes, and completing the rotational molding process.

9. A boat according to the method of claim 8.

10. A method of rotational molding a boat hull with first and second opposing hull walls interconnected by a plurality of rows of molded V-shaped joints, comprising the steps of:

providing a first mold section shaped according to the upper part of a boat hull and having a first mold surface for forming said first hull wall, said first mold surface having a plurality of rows of spaced apart V-shaped indentations;

providing a second mold section that assembles with the first mold section to form a closed mold, said second mold section shaped according to the lower part of a boat hull and having a second mold surface for forming said second hull wall, said second mold section relatively positionable with respect to the first mold section when the mold is closed so that the V-shaped indentations on the first mold surface project toward the second mold surface with apexes spaced from the second mold surface a distance forming a constriction of a size that will fill with molten material during a rotational molding process to form a molded connection between the first and second hull walls of the boat;

attaching a lattice truss structure to one of the mold sections in the vicinity where a hull side wall is to be formed;

closing the first and second mold sections, introducing a thermoplastic material into the closed mold cavity formed by the closed mold sections, heating the mold and rotating the mold about at least two axes, and completing the rotational molding process.

11. The method of claim 10 wherein:

the step of attaching a lattice truss to one of the mold sections comprises attaching the lattice truss to the first mold section.

12. A boat according to the method of claim 11.

13. A mold for the rotational molding of a boat hull having first and second boat hull walls interconnected by a plurality of rows of spaced apart molded joints, including:

a first mold section shaped according to the upper part of a boat hull and having a first mold surface for forming said first hull wall, said first mold surface having a plurality of channels and a plurality of rows of spaced apart V-shaped indentations located in the channels;

a second mold section that can be assembled to the first mold section, said second mold section shaped according to the lower part of a boat hull and having a second mold surface for forming said second hull wall and relatively positioned with respect to the first mold section when the first and second mold sections are closed, so that the V-shaped indentations on the first mold surface project toward the second mold surface a distance forming a constriction of a size that will fill with molten material during a rotational molding process to form a molded connection between the first and second hull walls of the boat.

14. A mold for the rotational molding of a boat hull having first and second boat hull walls interconnected by a plurality of rows of spaced apart molded joints, including:

a first mold section shaped according to the upper part of a boat hull and having a first mold surface for forming said first hull wall, said first mold surface having a plurality of rows of spaced apart V-shaped indentations;

a second mold section that can be assembled to the first mold section, said second mold section shaped according to the lower part of a boat hull and having a second mold surface for forming said second hull wall and relatively positioned with respect to the first mold section when the first and second mold sections are closed, so that the V-shaped indentations on the first mold surface project toward the second mold surface a distance forming a constriction of a size that will fill with molten material during a rotational molding process to form a molded connection between the first and second hull walls of the boat;

a lattice truss assembled to one of the mold sections positioned to be embedded in one of the side walls of the boat.

15. A hollow walled structure formed by a rotational molding process and having a pair of interconnected, parallel walls, comprising:

a first wall;

a second wall parallel to and spaced apart from the first wall;

one of the walls having at least one longitudinal channel with an array of spaced apart connecting joints connecting the first wall to the second wall;

each connecting joint comprised as a V-shaped indentation directed toward the other wall with an apex that is bonded to the other wall during the rotational molding process.

16. A method of rotational molding a hollow walled structure having first and second opposing walls interconnected by a plurality of rows of molded V-shaped joints, comprising the steps of:

providing a first mold section shaped according to the upper part of the structure and having a first mold surface for forming said first wall, said first mold surface having a plurality of channels and a plurality of rows of spaced apart V-shaped indentations located in the channels;

providing a second mold section that assembles with the first mold section to form a closed mold, said second mold section shaped according to the lower part of the structure and having a second mold surface for forming said second wall, said second mold section relatively positionable with respect to the first mold section when the mold is closed so that the V-shaped indentations on the first mold surface project toward the second mold surface with apexes spaced from the second mold surface a distance forming a constriction of a size that will fill with molten material during a rotational molding process to form a molded connection between the first and second walls of the structure;

closing the first and second mold sections, introducing a thermoplastic material into the closed mold cavity formed by the closed mold sections, heating the mold and rotating the mold about at least two axes, and completing the rotational molding process.

17. A hollow walled boat formed by a rotational molding process, including:

a hull having hollow side walls and a hollow bottom wall;

said side walls formed of a molded inner side wall component and a molded outer side wall component;

a lattice truss rotationally molded into the side walls of the hull between the inner and outer side wall components;

said lattice truss including polygonal braces having legs molded into the side wall components.

18. The boat of claim 17 wherein:

said lattice truss includes teenut connectors molded into the boat hull.

19. The boat of claim 17, wherein:

said side wall components are connected by a gunwale, and including teenut connectors molded into the gunwale.

20. The boat of claim 17 wherein:

said lattice truss includes longitudinal stringers, diagonal members connected to the stringers, polygonal braces connected to diagonal members, said braces having legs molded into side wall components of the side walls.

21. The boat of claim 20 including:

a plurality of teenut connectors connected to the lattice truss and molded into the boat hull.

* * * * *